US005749812A

United States Patent [19]

Feciura et al.

[11] Patent Number: 5,749,812

[45] Date of Patent: May 12, 1998

[54] SPEED JUMP ROPE BALL-BEARING SWIVEL ATTACHMENT

[76] Inventors: Paul N. Feciura, 1906 Coppersmith Ter.; Anthony N. Lee, 1922 Coppersmith Ter., both of Woodbridge, Va. 22191

[21] Appl. No.: 780,355

[22] Filed: Jan. 8, 1997

[51] Int. Cl.[6] ..... A63B 11/02

[52] U.S. Cl. ..... 482/82

[58] Field of Search ..... 482/82, 81, 148; 59/95

[56] References Cited

U.S. PATENT DOCUMENTS

| | | | |
|---|---|---|---|
| 2,466,243 | 4/1949 | Johnson | 59/95 |
| 2,942,881 | 6/1960 | Recalma | 482/82 |
| 4,101,123 | 7/1978 | Anthony | 482/82 |
| 4,801,137 | 1/1989 | Douglass | 482/82 |

*Primary Examiner*—Stephen R. Crow

[57] ABSTRACT

The application of a specific ball-bearing swivel which houses several ball-bearings, between the handles and rope material of a jump rope including a threaded member on the cap end and an O-ring on the spindle end will virtually eliminate the friction and drag associated with a conventional jump rope and allow free rotation of the jump rope material while attached to the handles.

1 Claim, 1 Drawing Sheet

SPEED JUMP ROPE BALL-BEARING SWIVEL ATTACHMENT

BACKGROUND OF THE INVENTION

This invention relates to the "application" of a specific ball-bearing swivel device which houses several ball-bearings, like the Sampo ball bearing swivel (U.S. Pat. No. 2,466,243) attached between the handles and the rope portion of a jump rope.

Rope jumping is quickly evolving as a popular method of cross training and sport. The sport and fitness aspect of the jump rope has been limited over the years to the speed in which one can turn the rope. The need to obtain jump rope speeds in excess of ten jumps per second is limited by the devices used to attach the jump rope handles to the rope material. Prior devices used to attach the handles to the rope material have had many disadvantages. One major difficulty is that the devices are unable to sufficiently reduce the amount of drag and friction created between the handles and rope material therefore limiting the speed of the rope and the jumper. Another common difficulty with the friction and drag generated by the high speed of the rope is excess wear and tear, resulting in untimely breakage of the rope material, handles and attachments.

BRIEF SUMMARY OF THE INVENTION

This invention is directed to the "application" of a specific style of ball-bearing swivel which houses several ball-bearings, like a Sampo ball bearing swivel (U.S. Pat. No. 2,466,243) for the purpose of greatly reducing the friction between the rope and handle of a jump rope. This ball bearing swivel, including a threaded member and an O-ring, will connect the handles to the rope material of a jump rope. The object of the present invention is to virtually eliminate the friction, drag and wear present in existing jump ropes. The jump rope ball bearing swivel comprises of a cap end which houses several ball bearings and a threaded member allowing the ball-bearing swivel to be attached to the jump rope handle with a washer and nut. The rotating spindle end of the ball bearing swivel houses an O-ring, allowing the ball-bearing swivel to be attached to the rope material of a jump rope using conventional methods.

DETAILED DESCRIPTION OF THE INVENTION

Figure 3:
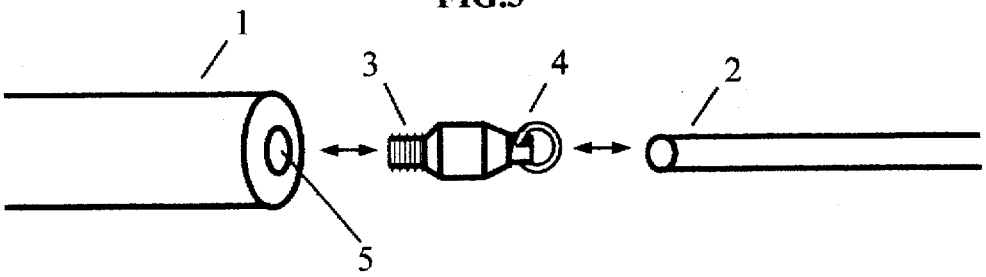
FIG. 3 is an exploded perspective view of the ball bearing swivel including an O-ring between the handles and rope material of a jump rope.
Figure 4:
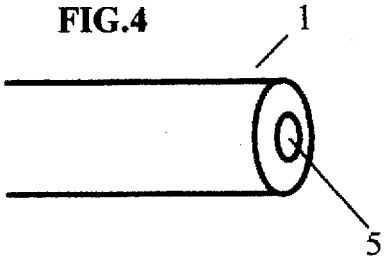
FIG. 4 shows a jump rope handle.
Figure 5:
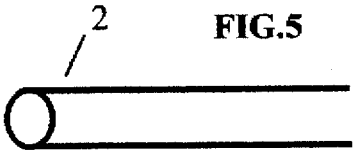
FIG. 5 shows a jump rope.

Referring to FIG. 3 the application of a ball-bearing swivel, like the Sampo ball-bearing swivel (U.S. Pat. No. 2,466,243) between the jump rope handle 1 and the rope material of a jump rope 2 allowing the rope material 2 to rotate freely while attached to the jump rope handles 1. The cap end of the ball-bearing 3 is mounted through a hole in the handle of the jump rope 5 with a threaded member and a nut (not shown). The rotating spindle including an O-ring 4 is attached to the rope material 2. A person(s) jumping rope can turn the rope with minimum rotation of the hands in any direction (forward or backward) at a very fast speed with little effort.

Figure 1:
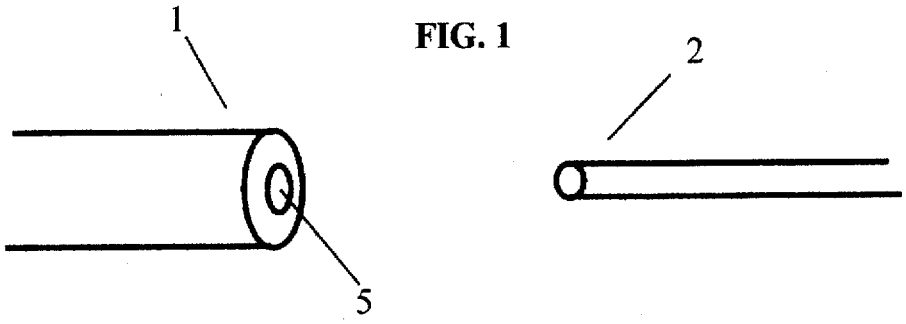
FIG. 1 is a perspective view of a ball bearing swivel including an O-ring attached between the handles and rope material of the jump rope of the invention.
Figure 2:
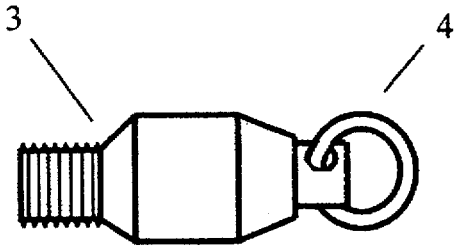
FIG. 2 is an enlarged plain view of a ball-bearing swivel which houses several ball-bearings.

Referring to FIG. 2 a ball-bearing swivel like the Sampo ball-bearing swivel, houses several ball-bearings in the cap end which allows virtually free rotation of the spindle and O-ring.

While there has been shown and described a preferred application of a ball-bearing swivel like the Sampo Ball Bearing (U.S. Pat. No. 2,466,243) between the handles and rope material of a jump rope, that changes in the ball-bearing manufacturer, handles, rope materials, sizes and shape can be made by those skilled in the art without departing from the invention. The invention is defined in the following claims.

We claim:

1. A jump rope device comprising:

(a) a pair of substantially tubular handles defining a bore, each handle having a closed first end and a second end having a threaded bore, (b) a pair of ball bearing swivel housings each having a threaded cap end and a spindle end having an O-ring, the threaded cap ends attached to the threaded bores of said handles, (c) a jump rope having each end attached to said O-ring; said jump rope having a longitudinal axis aligned generally co-axial to the longitudinal axis of each said handle; and wherein the swivel housings remain external to the handles.

* * * * *